United States Patent [19]

Swallow

[11] 4,415,345

[45] Nov. 15, 1983

[54] PROCESS TO SEPARATE NITROGEN FROM NATURAL GAS

[75] Inventor: Brian R. Swallow, Media, Pa.

[73] Assignee: Union Carbide Corporation, Danbury, Conn.

[21] Appl. No.: 362,048

[22] Filed: Mar. 26, 1982

[51] Int. Cl.[3] ..... F25J 3/02

[52] U.S. Cl. ..... 62/28; 62/30; 62/31; 62/34; 62/39

[58] Field of Search ..... 62/9, 11, 23, 24, 25, 62/26, 27, 28, 29, 30, 31, 32, 34, 38, 39, 43, 44

[56] References Cited

U.S. PATENT DOCUMENTS

| | | | |
|---|---|---|---|
| 2,583,090 | 1/1952 | Cost | 62/175.5 |
| 2,696,088 | 12/1954 | Twomey | 62/175.5 |
| 2,716,332 | 8/1955 | Haynes | 62/123 |
| 3,269,131 | 8/1966 | Becker | 62/30 |
| 3,721,099 | 3/1973 | Forg et al. | 62/29 |
| 4,230,469 | 10/1980 | Grimm et al. | 62/28 |

OTHER PUBLICATIONS

Jones, "Upgrade Low-Btu Gas," *Hydrocarbon Processing*, Sep. 1973, pp. 193–195.

*Primary Examiner*—Frank Sever
*Attorney, Agent, or Firm*—Stanley Ktorides

[57] ABSTRACT

A process to separate by rectification low concentration nitrogen from natural gases having a gradually increasing nitrogen concentration which employs a nitrogen heat pump cycle to generate necessary liquid reflux for a fractionation column and is compatible with both single column and double column process arrangements.

13 Claims, 3 Drawing Figures

PROCESS TO SEPARATE NITROGEN FROM NATURAL GAS

TECHNICAL FIELD

This invention relates to rhe field of cryogenic separation of gases and more particularly to a process for removing nitrogen from natural gases; the process is especially useful when the nitrogen content of a natural gas stream is initially low and increases considerably over a period of time.

BACKGROUND ART

Recovery of high quality natural gas is becoming increasingly important as the price of energy continues to rise. Furthermore, the use of natural gas tends to lessen the guantity of pollutants produced for a given amount of energy generated when compared to certain other commonly used means of energy generation.

One problem often encountered in nautral gas recovery whether from natural gas wells or petroleum reservoirs is nitrogen contamination. Natural gases which contain significant amounts of nitrogen may not meet minimum heating value specifications, reduce pipeline capacities and require additional compression horsepower and fuel consumption. Nitrogen removal from natural gases has therefore attained increased importance.

In many cases, successful recovery of petroleum or natural gas requires the use of an enhanced recovery technique. One such often used technique involves the injection into the reservoir of a fluid which will not support combustion; an often used fluid for this technique is nitrogen or a nitrogen-containing gas due to its relatively low cost compared to argon, helium and the like. However, the use of this technique increases the level of nitrogen contaminant in the gas recovered from the reservoir, i.e., the natural gases, above their naturally-occurring nitrogen concentration.

Nitrogen injection for enhanced oil or gas recovery introduces a further problem because the nitrogen concentration in the natural gases does not remain constant over the life of the recovery operation. Although the nitrogen concentration variation will strongly depend upon particular reservoir characteristics, a general pattern is predictable. Typically during the first few years that enhanced recovery with nitrogen injection is employed, the nitrogen concentration in the natural gases may remain at about the naturally-occurring level, increasing thereafter, for example, by about 5 percentage points after 4 years, by about 15 percentage points after 8 years, by about 25 percentage points after 10 years and by about 50 percentage points after 16 years.

The problem of a changing nitrogen concentration in natural gases recovered from the reservoir further complicates the economics of recovery. As shown, for example, in "Design Considerations For Nitrogen Rejection Plants," *R. A. Harris,* Apr. 17, 1980, The Randall Corp., Houston, Tex., the specific nitrogen removal process employed will be dictated by the nitrogen concentration. A nitrogen concentration of from 15 to 25 percent requires one type of process, a nitrogen concentration of from 25 to 40 percent requires another, a nitrogen concentration of 40 to 50 percent still another process, and a concentration greater than about 50 percent yet another process. The alternative, i.e., the use of only one process as the nitrogen concentration in the natural gases varies, is believed to result in severe operating inefficiencies.

In response to the problem of nitrogen contamination of natural gases, several methods of separating the nitrogen from the natural gases have been developed. One known method employs a dual pressure double distillation column; this type of arrangement is often used in the fractionation of air into oxygen and nitrogen. However, this method is generally limited to applications where the nitrogen concentration of natural gases is greater than about 25 percent. Where the nitrogen concentration is lower than 25 percent, the quantity of reflux liquid that can be generated in the high pressure column when using the conventional double column process decreases to the extent that proper fractionation cannot be conducted in the low pressure column.

A description of a typical double distillation column process for separating nitrogen from natural gas is disclosed in Jones, "Upgrade Low-Btu Gas," *Hydrocarbon Processing,* September 1973, pp. 193–195. Reflux for the low pressure column is provided by a nitrogen liquid generated within the high pressure column. At low nitrogen feed gas concentrations the required liquid nitrogen reflux cannot be generated resulting in high methane losses in the nitrogen exit stream.

Those skilled in the art have addressed this problem by recycling a portion of the nitrogen exit stream back to the natural gas feed stream, thus keeping the nitrogen concentration high enough for effective separation in the double distillation column. This method, however, is disadvantageous from two standpoints. First, use of a nitrogen recycle in this manner increases the plant size requirements. Second, this process leads to significantly increased power requirements since relatively pure nitrogen from the exit stream must be separated all over again from the natural gas feed.

Also known are single column processes for removing nitrogen from natural gas. One such process is disclosed in U.S. Pat. No. 2,583,090—Cost, wherein a high pressure feed having a nitrogen concentration of about 40 percent is cooled and expanded into a single fractionation column. Reflux liquid is obtained by condensing overhead nitrogen gas in a liquefier by heat exchange with work expanded nitrogen gas. At lower nitrogen feed gas concentrations, for example at about 30 percent nitrogen, a nitrogen recycle stream is employed to develop the additional refrigeration and reflux required. This is accomplished by warming some of the work expanded nitrogen gas, compressing it to about the fractionation pressure, cooling it against the nitrogen gas to be compressed and then mixing it with the nitrogen gas which is to be work expanded. This process is relatively expensive from both a capital equipment cost and a power consumption cost standpoint.

Another single column process to remove nitrogen from methane is disclosed in U.S. Pat. No. 2,696,088—Toomey. Reflux for the fractionation column which is operated at relatively low pressure, is provided by liquefying a portion of the nitrogen overhead. The necessary refrigeration for this liquefaction is provided by a cascaded refrigeration system employing an ammonia cycle, an ethylene cycle and methane cycle. This process is disadvantageous because it is considerably complex and consumes a large amount of power.

A process which can effectively separate nitrogen from natural gases wherein the nitrogen concentration of the natural gas feed is initially low, and which avoids the heretofore disclosed uneconomical methods required to compensate for the low nitrogen concentration in the feed would be highly desirable.

More importantly, none of the known processes for removing nitrogen from natural gases is directed to situations where the nitrogen concentration in the feed gas increases substantially over time such as is typically experienced when nitrogen injection enhanced recovery is employed. Processes which adequately separate nitrogen from natural gases at high nitrogen feed gas concentrations must be significantly altered to achieve good separation at low nitrogen feed gas concentrations. These alterations invariably increase the capital and/or operating costs of the system in order to achieve the desired separation. Therefore, a process which will achieve good separation of nitrogen from natural gases over a wide range of nitrogen concentrations in the feed, while substantially avoiding the increased capital and/or operating costs of heretofore available processes is highly desirable.

Therefore, it is an object of this invention to provide an improved process for the separation of nitrogen from natural gases.

It is another object of this invention to provide an improved process for the separation of nitrogen from natural gases capable of handling a natural gas feed stream in which the nitrogen concentration is relatively low.

It is a further object of this invention to provide an improved process for the separation of nitrogen from natural gases capable of handling a natural gas feed stream in which the nitrogen concentration may vary considerably.

DISCLOSURE OF THE INVENTION

The above and other objects which will become apparent to those skilled in the art are obtained by the improved process of this invention which comprises:

A process for separating nitrogen from natural gases comprising:

(1) introducing a nitrogen-containing natural gas stream into a fractionation column operating at a pressure of from 15 to 125 psia;

(2) separating by rectification said nitrogen-containing natural gas stream into a nitrogen-enriched vapor portion A and a methane-enriched liquid portion B;

(3) providing a nitrogen-containing vapor stream C;

(4) warming said nitrogen-containing vapor stream C;

(5) compressing the warming nitrogen-containing vapor stream C to a pressure of from about 50 to 470 psia;

(6) cooling the compressed nitrogen-containing stream C by indirect heat exchange with the warming nitrogen-containing stream of step (4);

(7) condensing the cooled compressed nitrogen-containing stream C by indirect heat exchange with said methane-enriched liquid portion B, thereby providing vapor reflux to the fractionation column;

(8) throttling the condensed nitrogen-containing liquid stream C to about the pressure of the fractionation column;

(9) employing the throttled nitrogen-containing liquid stream C to provide liquid relfux for the fractionation column; and

(10) recovering at least a portion of said methane enriched portion B as product natural gases.

The term, column, is used to mean a distillation or fractionation column, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For an expanded discussion of fractionation columns see the Chemical Engineer's Handbook, Fifth Edition, edited by R. H. Perry and C. H. Chilton, McGraw-Hill Book Company, New York Section 13, "Distillation" B. D. Smith et al., page 13-3, *The Continuous Distillation Process.*

The term, double column, is used to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation.

The terms, natural gas and natural gases, are used to mean a methane-containing fluid, such as is generally recovered from natural gas wells or petroluem reservoirs.

The term, nitrogen-containing natural gas stream, is used to mean a natural gas stream having a nitrogen concentration of from 1 to 99 percent.

The process of this invention can effectively separate nitrogen from natural gas at constant nitrogen feed gas concentration and also when the nitrogen concentration varies either quickly or over a period of years.

DETAILED DESCRIPTION

Figure 2:
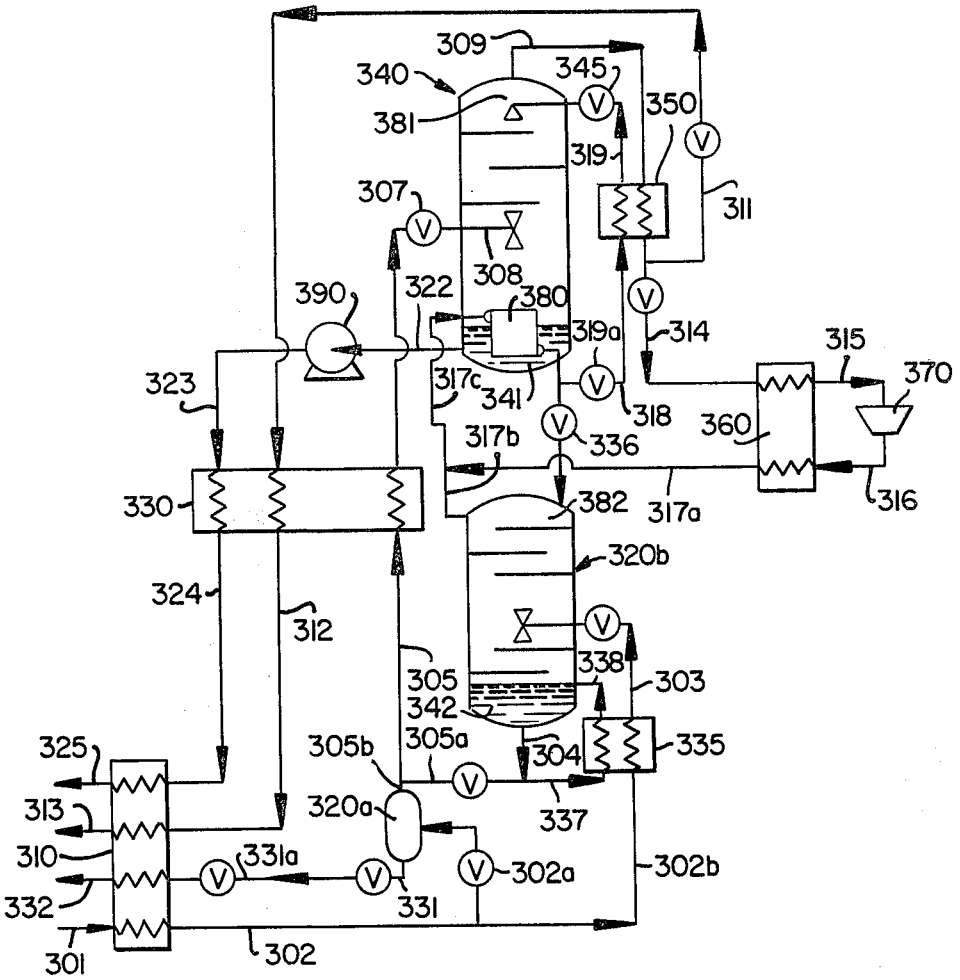
FIG. 2 is a flow diagram representing one preferred embodiment of the process of this invention employed in conjunction with a double column separation.
Figure 3:
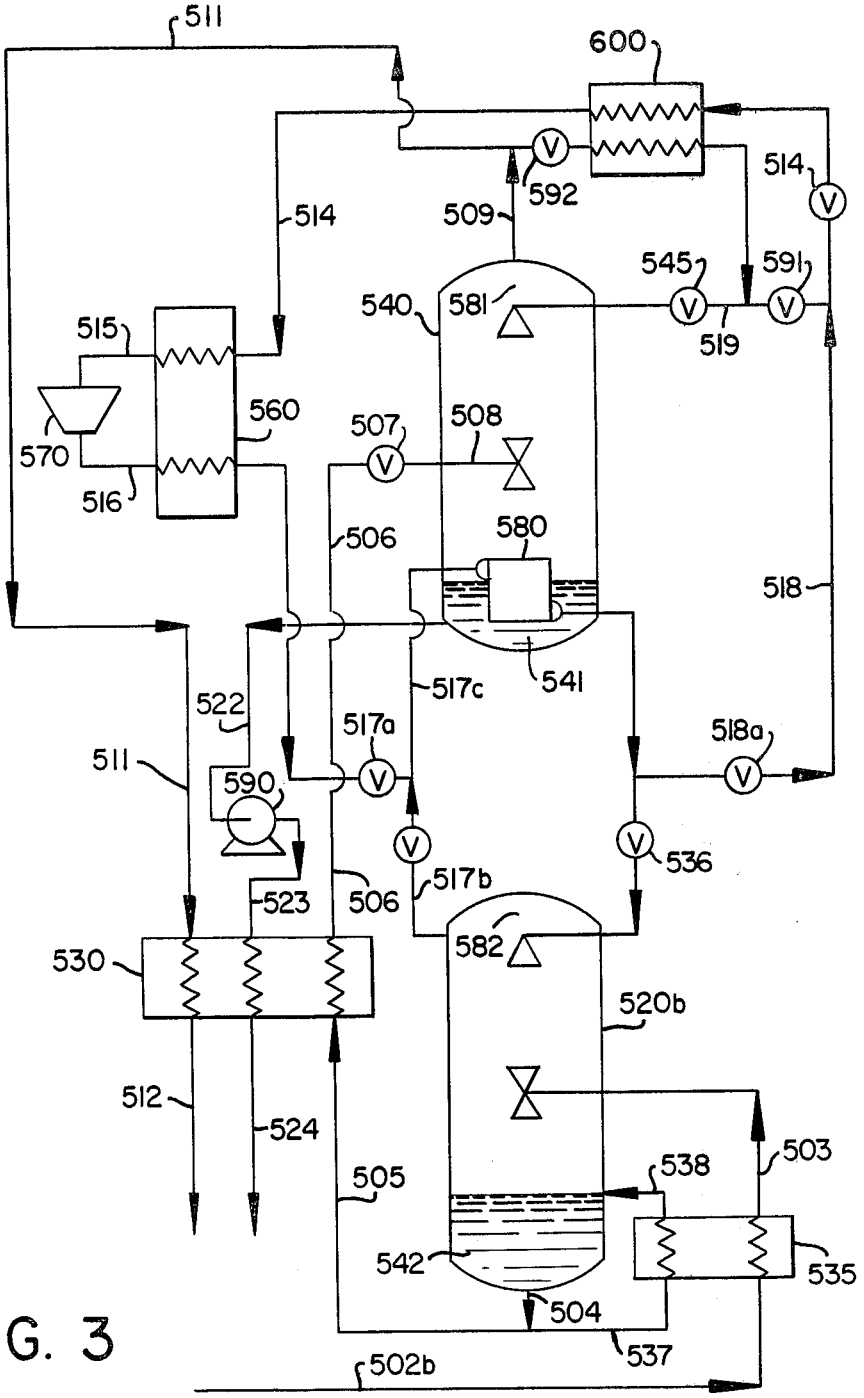
FIG. 3 is a flow diagram representing another embodiment of the process of this invention employed in conjunction with a double column separation.

The improved process of this invention will be described in detail with reference to FIGS. 1, 2 and 3.

Figure 1:
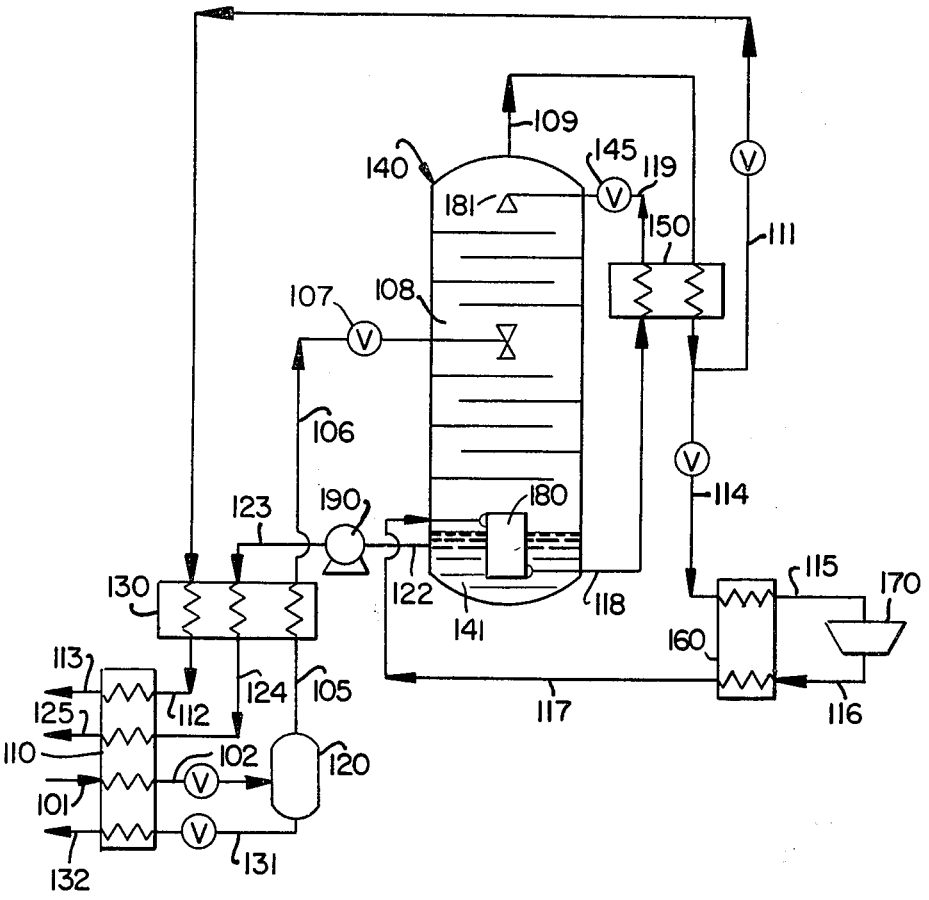
FIG. 1 is a flow diagram representing one preferred embodiment of the process of this invention employed in conjunction with a single column separation.

Referring now to FIG. 1, a natural gas feed 101 having a nitrogen content of, for example, about 15 percent or less, generally at an elevated pressure such as 200 psia or more such as is characteristic of natural gas from a well, which has been treated, for example, by molecular sieve adsorption, to remove condensibles such as water and carbon dioxide is cooled in heat exchanger 110 to partially condense the feed which is conducted 102 to separator 120. The liquid fraction, which, depending upon feed gas components, may constitute about 80 percent of the original feed, is returned 131 to heat exchanger 110 and recovered as natural gas product. The gaseous fraction, which contains the major portion of the nitrogen in the feed, is conducted 105 to heat exchanger 130 where it is cooled to produce a subcooled high pressure liquid 106 which is throttled through valve 107 to a pressure of from about 15 psia to 125 psia, generally to about 20 psia to 60 psia, and is introduced 108 to column 140 as feed wherein it is separated into nitrogen-enriched overhead 181 and methane-enriched bottoms 141.

Some of the nitrogen-enriched overhead is withdrawn 109 from the column to initiate the heat pump circuit of the process of this invention. The nitrogen-enriched stream 109 is warmed in heat exchanger 150. A portion of the nitrogen-enriched stream passes through conduit 111, heat exchanger 130, conduit 112, heat exchanger 110 and vent 113 as a nitrogen product steam. In applications where the process of this invention is used in conjunction with nitrogen injection for enhanced oil or gas recovery, this nitrogen product stream may conveniently be employed for injection into the well or reservoir.

The other portion of the nitrogen-enriched stream is then passed 114 to heat exchanger 160 where it is warmed further, typically to ambient temperature, and then passed 115 to compressor 170 where it is compressed to a pressure of from about 50 psia to 470 psia, generally to about 200 psia to 400 psia. The lower pressure limit is determined by the minimum acceptable product purities and the upper pressure limit is determined by the critical pressure of the heat pump fluid, which in this case is overhead or vent nitrogen.

The compressed stream is then passed 116 to heat exchanger 160 where it is cooled against the warming nitrogen-enriched stream. The cooled stream 117 is then condensed in condenser 180 against the methane-enriched fraction 141, passed 118 to heat exchanger 150 where it is further cooled and passed 119 to valve 145 where it is throttled to the pressure of the column and introduced to the column as liquid reflux. As discussed above, the column may operate in the broadest range, at a pressure of from about 15 psia to 125 psia. The lower pressure limit is determined by pressure drops within the system. The upper pressure limit is determined by the minimum acceptable product purities.

Typically, the nitrogen-enriched stream will have a nitrogen concentration above about 95 percent while the methane-enriched portion will have a methane concentration above about 90 percent, although products of lesser purity may be acceptable depending upon the desired uses of the products.

Referring back to FIG. 1, the heat necessary for generating the vapor reflux for column 140 is provided by the condensing nitrogen-enriched stream in condenser 180. Therefore, the pressure and flow rate of the condensing nitrogen-enriched stream must be determined so as to provide the necessary heat transfer between the high pressure nitrogen-enriched stream and the low pressure methane-enriched bottoms. The methane-enriched bottoms 141 is removed through conduit 122 to pump 190, pumped to, for example, about 195 psia, passed 123 through heat exchanger 130, conduit 124 and heat exchanger 110, and recovered as methane product 125. This stream will generally be pumped to as high a pressure as possible consistent with heat transfer constraints in subsequent heat exchange operations. Thus, by use of the process of this invention employing the nitrogen heat pump cycle, one can now effectively separate nitrogen from natural gas wherein nitrogen constitutes about 15 percent or less of the natural gas. As will be demonstrated later, the effective nitrogen separation is accomplished without recycling nitrogen back to the feed to artificially increase the nitrogen level throughout the process to the point necessary to generate sufficient liquid reflux in a double column arrangement. Thus, significant capital and operating expenditures are avoided.

At nitrogen concentrations in the natural gas feed above about 25 percent and especially above about 35 percent, one does not encounter the problem of low nitrogen reflux in the double column arrangement. Typically, at these higher nitrogen concentrations a double distillation column arrangement is employed because it is capable of separating the feed gas into overhead and bottom products at a much lower energy expenditure.

However, as previously explained, in a natural gas recovery operation wherein nitrogen injection is employed as an enhanced recovery technique the natural gas feed may exhibit a steadily increasing nitrogen concentration but one that will require a number of years before it reaches the level necessary for a good double column separation. Heretofore, as previously discussed, it has been necessary during the period of time characterized by low nitrogen feed gas concentration to artificially increase the nitrogen concentration in the feed, or to run two different processes during the life of the well, to run in some other inefficient mode, or to simply forego nitorgen rejection at the low nitrogen concentrations.

Applicant has discovered that his process employing the nitrogen heat pump cycle can be easily integrated with conventional double column arrangements so as to allow efficient separation of nitrogen from natural gas at all nitrogen concentrations with, in effect, only one process arrangement. One embodiment of such double column arrangement is described with reference to FIG. 2. In FIG. 2 the streams and apparatus are numbered similar to FIG. 1 plus 200. As one can see, FIG. 2 essentially illustrates the arrangement of FIG. 1 with the addition of a high pressure column. The flow streams which differ significantly from those described in FIG. 1 are described in detail below.

A nitrogen-containing natural gas feed 301, which is free of condensibles such as water and carbon dioxide is cooled in heat exchanger 310 such that it is partially condensed. It is then passed in conduit 302, depending on the incoming nitrogen concentration, through valve **302*a* to separator 320*a* or through conduit 302*b* and ultimately to high pressure column 320*b*. When the nitrogen concentration in the feed is below about 15 percent, the natural gas will be introduced into separator 320*a*, valved conduit 303 being closed during such conditions. At nitrogen concentrations above about 15 percent in the feed, valved conduit 302*a* will be closed and valved conduit 303 will be open permitting the natural gas feedstock to flow through heat exchanger 335 and into column 320*b*. If the partially condensed natural gas feedstock has been introduced into separator 320*a*, then the liquid fraction is removed through valved conduit 331, conducted through heat exchanger 310, and is recovered as a high pressure methane product in conduit 332. Similarly, the vapor separated in separator 320*a* is conducted through conduits 305*b* and 305, heat exchanger 330, conduit 306, valve 307, and conduit 308 into the low pressure column 340. During such operation, valved conduit 305*a* would remain closed. As the concentration of nitrogen in the feed gas rises above about 15 percent, valved conduit 302*a* is closed while valved conduit 303 is opened; valved conduit 331 would similarly be closed while valved conduit 305*a* would also be opened. In this way, the low pressure rectification column 340 would receive a subcooled liquid feed originating from the methane-enriched liquid collected in the bottom of the high pressure recitification column 320*b*, i.e., through conduit 304 and 305*a* to 305. In similar fashion, at nitrogen concentrations below about 15 percent, valved conduit 314 would be opened whereas valved conduit 336** would normally be closed. As the nitrogen concentration increases from about 15 and 35 percent, valved conduit 336 would gradually be opened while valved conduit 314 would gradually be closed. In this way the reflux requirements for the nitrogen-methane separation would gradually be shifted from the heat pump circuit to the high pressure column. Eventually, as the concentration of nitrogen in the feedstock exceeds about 35 percent, valved conduit 314 would be entirely closed and valved conduit 336 would be substantially opened so that all of the required reflux is generated via the high pressure column 320*b*.

Thus, at nitrogen feed concentrations of about 15 percent or less, one has essentially the circuit described with reference to FIG. 1. At nitrogen feed concentrations of greater than about 35 percent one has a conventional double column arrangement which is well known to those skilled in the art. At nitrogen feed concentrationss of from about 15 to 35 percent one has a process employing a combination of the dual column arrangement and the nitrogen heat pump circuit of the process of this invention. This system is described in detail below with reference to FIG. 2.

A natural gas stream 301, for example at a pressure greater than about 200 psia, containing from about 15 to about 35 percent nitrogen is cooled and partially condensed in heat exchager 310 and passed 302*b* to heat exchanger 335 where it is further condensed. The stream is conducted through valved conduit 303 to high pressure column 320*b* where it is separated into a nitrogen-enriched overhead 382 and a methane-enriched bottom 342. A portion of the methane-enriched bottom passes through conduits 304 and 337 to heat exchanger 335 where it is partially reboiled and then introduced to the bottom of column 320*b* through conduit 338. Another portion of the bottoms passes through conduits 304, 305*a* and 305 to heat exchanger 330 where it is cooled to produce a subcooled liquid which is then passed through conduit 306, valve 307 and fed through conduit 308 into low pressure column 340. The stream is throttled as it passes through valve 307 to a pressure compatible with the low pressure column.

In column 340 the feed is separated into a nitrogen enriched overhead 381 and a methane-enriched bottom 341. The overhead in conduit 309 is warmed in heat exchanger 350. A portion of this stream passes through conduit 311, heat exchanger 330, conduit 312, heat exchanger 310 and vent 313. Another portion of the overhead stream is passed through conduit 314 to heat exchanger 360 where it is further warmed and then passed 315 to compressor 370 where it is compressed to a pressure of from about 50 psia to 470 psia, generally from 200 psia to 400 psia. The pressure will depend on process conditions such as the desired purity of the product streams as is recognized by those skilled in this art. The compressed stream is then passed to heat exchanger 360 where it is cooled against the warming nitrogen-enriched overhead stream. The cooled compressed stream 317*a* joins the high pressure nitrogen-enriched overhead stream 317*b* and is passed through conduit 317*c* to condenser 380 where it is condensed against the methane-enriched bottoms thus reboiling the bottoms to produce vapor reflux for the low pressure column 340. A portion of the condensed high pressure nitrogen-enriched stream is passed through valve 318*a*, conduit 318, heat exchanger 350, conduit 319, valve 335 and back to column 340 as liquid reflux. The stream is throttled through valve 345 to a lower pressure compatible with column 340.

As one can readily appreciate, the circuit described in the previous two paragraphs is essentially the heat pump circuit of the process of this invention which was described with reference to FIG. 1. Thus it is shown that the improved process of this invention is readily compatible with typical double column separation processes which are conventional in the industry. The ease of integration of the nitrogen heat pump circuit of the process of this invention into either single or double column separation arrangements is of great utility to the gas separation industry.

Continuing now with the description of the separation wherein the feed has a nitrogen content of from about 15 to 35 percent, another portion of the condensed high pressure nitrogen-enriched stream is passed through valve 336 to column 320*b* as liquid reflux. The methane-rich bottoms from low pressure column 340 are removed through conduit 322 to pump 390, pumped to about 195 psia for example, passed 323 through heat exchanger 330, conduit 324 and heat exchanger 310 and recovered as methane product 325.

Another embodiment of the process of this invention is illustrated with reference to FIG. 3. In FIG. 3 the numbering is identical to that of FIG. 2 plus 200. As can be seen the embodiment of FIG. 3 is shown with reference to a double column arrangement. However, in this embodiment the heat pump fluid is not taken from the nitrogen-enriched overhead vapor 581 of the low pressure column. Instead, a stream 509 of this vapor is withdrawn from the low pressure column and condensed by indirect heat exchange with a nitrogen-containing stream which serves as the heat pump fluid. The condensed nitrogen-enriched stream is then returned to the low pressure column as liquid reflux.

As the nitrogen-containing natural gas feed to the high pressure column increases from about 15 to 35 percent an increasing portion of the nitrogen-containing heat pump fluid stream is provided from the nitrogen enriched overhead vapor 582 of the high pressure column; when the nitrogen concentration of the feed exceeds about 35 percent, substantially all of the reflux for the low pressure column is provided via the high pressure column. There now follows a detailed discussion of the embodiment of FIG. 3.

A nitrogen-containing natural gas feed stream at a pressure of, for example, about 200 psia, is delivered through conduit 502*b*, heat exchanger 535 and conduit 503 to high pressure fractionation column 520*b*. In this column the feed is separated into a nitrogen-enriched vapor portion 582 and a methane-enriched liquid portion 542. This liquid portion is withdrawn through conduit 504 and a portion is passed 537 to heat exchanger 535 and then through conduit 538 back to the high pressure column for vapor reflex.

A portion of stream 504 is passed through conduit 505 and then passed to the low pressure column 540 through heat exchanger 530, conduit 506, valve 507 and conduit 508. This feed stream is separated into a nitrogen-enriched overhead vapor 581 and a methane-enriched liquid 541. The methane-enriched liquid withdrawn through conduit 522 is pressurized in pump 590 warmed in heat exchanger 530 and discharged through conduit 512.

Reboil for column 540 is provided by condensing a nitrogen-containing stream 517*c* in condenser 580 to boil the methane-enriched portion 541. At nitrogen concentrations in the natural gas feed stream below about 15 percent, stream 517*c* originates solely from the heat pump circuit through valve 517*a* and the natural gas feed is delivered directly to the low pressure column as described in detail with reference to FIG. 2. At feed stream nitrogen concentrations of from about 15 percent to about 35 percent, stream 517*c* is formed in part from the heat pump circuit through valve 517*a* and in part from a stream 517*b* withdrawn from the high pressure column containing some of the nitrogen-enriched vapor portion 582. At feed stream nitrogen concentrations exceeding about 35 percent, stream 517*c* originates solely from stream 517*b*.

Liquid reflux 519 for column 540 is provided by a nitrogen-enriched liquid. At nitrogen concentrations in the natural gas feed stream below about 15 percent, reflux 519 is provided by withdrawing through conduit 509 a portion of the low pressure column nitrogen-enriched vapor 581, passing this portion through valve 592 and heat exchanger 600 where it is condensed by indirect heat exchange with the heat pump fluid and then returning this condensed stream back to the low pressure column through valve 345 as liquid reflux. At feed stream nitrogen concentrations of from about 15 percent to about 35 percent, reflux 519 is provided in part by withdrawing and condensing a portion of the low pressure column nitrogen-enriched vapor 581 and in part by diverting a portion of heat pump fluid stream 518 through valve 591. At feed stream nitrogen concentrations of greater than about 35 percent, all of reflux 519 is provided by diverting fluid 518 through valve 591.

As can be ascertained from the discussion of FIG. 3, at a nitrogen feed stream concentration below about 15 percent valved conduit 517*b* and valves 536 and 591 are closed and valves 514, 517*a* and 592 are open. The natural gas feed is delivered directly to the low pressure column. As the feed stream nitrogen concentration increases from about 15 percent to about 35 percent the valved conduit 517*b* and valves 536 and 591 are gradually opened and valves 514, 517*a* and 592 are gradually closed until at about a 35 percent nitrogen feed stream concentration they are respectively fully opened or fully closed. In this way the refux requirements for the low pressure column are gradually shifted from the heat pump circuit to the high pressure column as the feed stream nitrogen concentration increases from about 15 percent to about 35 percent.

The determination of which of the embodiments of this invention will be the most preferred embodiment will be, in part, an engineering decision and will depend on the particular conditions of any specific application.

Table I summarizes a computer simulation of the process of this invention employing the process arrangement of FIG. 1. The stream numbers correspond to those of FIG. 1. In the table, the nitrogen is not mass-balanced because some is withdrawn from the heat pump cycle after compression. The nitrogen recycle stream 117 data represents the accumulated nitrogen at steady state conditions. As shown, the process of this invention effectively separates nitrogen and methane at low nitrogen feed gas concentrations without the need for nitrogen recycle to the feed.

TABLE I

| | |
|---|---|
| FEED 101 | |
| PRESSURE (Psia) | 600 |
| FLOW RATE (lbm/hr) | 10471 |
| METHANE (%) | 90.9 |
| NITROGEN (%) | 6.1 |
| HIGH PRESSURE | |

TABLE I-continued

| | |
|---|---|
| METHANE PRODUCT 125 | |
| PRESSURE (psia) | 350 |
| FLOW RATE (lbm/hr) | 6492 |
| METHANE (%) | 92.3 |
| NITROGEN (%) | 3.1 |
| LOW PRESSURE | |
| METHANE PRODUCT 132 | |
| PRESSURE (psia) | 195 |
| FLOW RATE (lbm/hr) | 3672 |
| METHANE (%) | 96.1 |
| NITROGEN (%) | 3.5 |
| NITROGEN PRODUCT 113 | |
| PRESSURE (psia) | 29.6 |
| FLOW RATE (lbm/hr) | 117.2 |
| METHANE (%) | 0.5 |
| NITROGEN (%) | 99.5 |
| NITROGEN RECYCLE 117 | |
| PRESSURE (psia) | 350 |
| FLOW RATE (lbm/hr) | 1262 |
| METHANE (%) | 0.5 |
| NITROGEN (%) | 99.5 |

I claim:

1. A process for separating nitrogen from natural gases comprising:

(a) providing a natural gas feed stream having a nitorgen concentration, which varies over time, of from 1 to 35 percent;

(b) introducing said nitrogen-containing natural gas stream into a fractionation column operating at a pressure of from 15 to 125 psia;

(c) separating by recitification said nitrogen-containing natural gas stream into a nitrogen-enriched vapor portion A and a methane-enriched liquid portion B;

(d) providing a nitrogen-containing vapor stream C;

(e) warming said nitrogen-containing vapor stream C;

(f) compressing the warming nitrogen-containing vapor stream C to a pressure of from about 50 to 470 psia;

(g) cooling the compressed nitrogen-containing stream C by indirect heat exchange with the warming nitrogen-containing stream of step (e);

(h) condensing the cooled compressed nitrogen-containing stream C by indirect heat exchange with said methane-enriched liquid portion B, thereby providing vapor reflux to the fractionation column;

(i) throttling the condensed nitrogen-containing liquid stream C to about the pressure of the fractionation column;

(j) employing the throttled nitrogen-containing liquid stream C to provide liquid reflux for the fractionation column; and (k) recovering at least a portion of said methane-enriched portion B as product natural gases.

2. The process of claim 1 wherein said fractionation column is operating at a pressure of from 20 psia to 60 psia.

3. The process of claim 1 whereby said nitrogen-containing vapor stream C of step (f) is compressed to a pressure of from 200 psia to 400 psia.

4. The process of claim 1 whereby a portion of said nitrogen-enriched vapor portion A is withdrawn from the fractionation column to form at least a portion of nitrogen-containing vapor stream C of step (d), and wherein step (j) is accomplished by introducing the throttled nitrogen-containing liquid stream C to said fractionation column as liquid reflux.

5. The process of claim 4 wherein all of nitrogen-containing vapor stream C is formed by the withdrawal of a portion of nitrogen-enriched vapor portion A from the fractionation column.

6. The process of claim 4 wherein said fractionation column is a first fractionation column in heat exchange relation with a second fractionation column which is operating at a higher pressure than said first fractionation column, wherein a nitrogen-containing natural gas stream is introduced into said higher pressure column at the column pressure and is separated by rectification into a nitrogen-enriched vapor portion and a methane-enriched liquid portion, wherein a portion of stream C is provided by a stream withdrawn from said higher pressure column nitrogen-enriched vapor portion and wherein said portion of stream C which is provided by withdrawal from the high pressure column increases as the nitrogen concentration of the nitrogen-containing natural gas stream introduced to said higher pressure column increases from about 15 percent to about 35 percent.

7. The process of claim 1 wherein at least a portion of the liquid reflux of step (j) is provided by:

(A) withdrawing from the fractionation column a stream of said nitrogen-enriched vapor portion A;

(B) condensing said stream of nitrogen-enriched vapor portion A by indirect heat exchange with said throttled nitrogen-containing liquid stream C; and (C) returning the condensed stream of nitrogen enriched portion A to said fractionation column as liquid reflux.

8. The process of claim 7 wherein all of the liquid reflux of step (j) is provided by steps (A), (B) and (C).

9. The process of claim 7 wherein said fractiontion column is a first fractionation column in heat exchage relation with a second fractionation column which is operating at a higher pressure than said first fractionation column, wherein a nirogen-containing natural gas stream is introduced into said higher pressure column at the column pressure and is separated by rectification into a nitrogen-enriched vapor portion and a methane-enriched liquid portion, wherein a portion of stream C is provided from a stream withdrawn from said higher pressure column nitrogen-enriched vapor portion and a portion of throttled nitrogen-containing liquid stream C is introduced to the first fractionation column to provide a portion of the liquid reflux of step (j), and wherein said portion of stream C which is provided from the stream withdrawn from the higher pressure column and said portion of throttled liquid stream C which is introduced to the fractionation column to provide a portion of the liquid reflux of step (j) increase as the nitrogen concentration of the nitrogen-containing natural gas stream introduced to said higher pressure column increases from about 15 percent to about 35 percent.

10. The process of claim 6 or 9 wherein said higher pressure column is operating at a pressure at least equal to 50 psia.

11. The process of claim 10 wherein said higher pressure column is operating at a pressure at least equal to 200 psia.

12. The process of claim 6 or 9 wherein a portion of the methane-enriched liquid portion of the second higher pressure column is withdrawn from the second higher pressure column, is throttled to the pressure of the first fractionation column and is introduced to the first fractionation column as the nitrogen-containing natural gas stream of step (b).

13. The process of claim 1 wherein at least a portion of said nitrogen-enriched portion A is recovered as product nitrogen gas.

* * * * *